US006840414B2

(12) United States Patent
Ziegler

(10) Patent No.: US 6,840,414 B2
(45) Date of Patent: Jan. 11, 2005

(54) GOLF SCORING AIDS

(76) Inventor: Karl A. Ziegler, 183 Spangsville Rd., Oley, PA (US) 19547

( * ) Notice: Subject to any disclaimer, the term of this patent is extended or adjusted under 35 U.S.C. 154(b) by 95 days.

(21) Appl. No.: 10/408,620

(22) Filed: Apr. 7, 2003

(65) Prior Publication Data

US 2004/0031828 A1 Feb. 19, 2004

Related U.S. Application Data

(60) Provisional application No. 60/371,880, filed on Apr. 12, 2002.

(51) Int. Cl.[7] ..... B65H 75/40

(52) U.S. Cl. ..... 224/162; 224/576; 242/385.1; 248/579; 401/88; 401/131

(58) Field of Search ..... 224/162, 576; 401/88, 99, 131, 195; 242/385.1; 248/579

(56) References Cited

U.S. PATENT DOCUMENTS

| | | | | | |
|---|---|---|---|---|---|
| 245,257 | A | * | 8/1881 | Wright | 242/379 |
| 5,947,623 | A | * | 9/1999 | Smith | 401/131 |
| 6,065,892 | A | * | 5/2000 | Smith | 401/209 |
| 6,190,078 | B1 | * | 2/2001 | Smith | 401/195 |
| 6,257,469 | B1 | * | 7/2001 | Cohn | 224/162 |
| 6,318,921 | B1 | * | 11/2001 | Craine | 401/131 |
| 6,419,413 | B1 | * | 7/2002 | Oliver et al. | 401/131 |
| 6,499,899 | B2 | * | 12/2002 | Sawyer | 401/131 |

* cited by examiner

*Primary Examiner*—Stephen K. Cronin
(74) *Attorney, Agent, or Firm*—Richard O. Church

(57) ABSTRACT

An assembly for facilitating the recording of golf scores adapted to be secured to a golf bag or clothing of the scorer. The assembly includes holders for a pencil and a golf score card which are affixed to the distal ends of separate cords that can be retractably withdrawn from spring loaded storage reels.

1 Claim, 2 Drawing Sheets

GOLF SCORING AIDS

PRIOR APPLICATION

This application is based upon and claims priority from Provisional Patent Application 60/371,880 filed on Apr. 12, 2002.

TECHNICAL FIELD

This invention relates to the game of golf and, more particularly, to a golf scoring aid that holds a score card and a writing instrument for easy access. The card and writing instrument, the later usually being a pencil stub, are secured to the scoring aid by a pair of retractable cords wound on spring loaded reel assemblies. Attachment means, such as a clasp or ring assembly is mounted on the golf scoring aid to make it simple to attach the device to any convenient object such as a golf bag or the clothing of a score keeper.

BACKGROUND OF THE INVENTION

The inconvenience of carrying a score card and pencil to record the strokes taken on a given hole has been experienced by anyone who has played the game of golf. Usually the card and pencil are carried in a pocket, such as in the shirt, pants or golf bag of the golfer. The card can easily become creased, dog-eared or otherwise defaced when it is repeatedly inserted and taken out of the pocket. The pencil is a nuisance to find when mixed with balls, tees and other loose pocket items. The pencil can break or stab a person when one is "fishing" for the pencil in a pocket of one's clothes or golf bag.

A number of devices have been suggested in the prior art that can make the score card and pencil more accessible. For example a device is disclosed in U.S. Pat. No. 4,157,152 which includes a rigid panel with a spring clip mounted at one end of the panel. The pencil and the score card are held on the panel by the clip and the panel, in turn, is fastened to a golf bag. In use, the pencil is removed from the device and the score is marked on the scorecard with the rigid panel providing a firm writing surface.

U.S. Pat. No. 2,523,590 illustrates a device that includes a clipboard with a spring biased clip positioned at one end and a pair of clamps for attaching the clip board to the handle of a golf cart.

U.S. Pat. No. 4,361,934 discloses a pencil and score card that are retained on elastic bands that, in turn, are attached to a central mounting fixture.

SUMMARY OF THE INVENTION

It is an object of the invention to provide methods and means for carrying a golf score card and a writing implement.

A further object of the invention is to provide means to enable ready access to a score card and pencil when playing a game of golf.

A further object of the invention is to provide a convenient means for reaching a golf score card without unduly defacing the card or otherwise making it difficult to read.

Yet a further object of the invention is to provide safe, convenient and readily accessible protective means for carrying a marking device, such as a pencil stub, when playing the game of golf.

These and other objects of the invention are achieved by providing an assembly to which a golf card and a writing instrument are attached by retractable cords wound on spring loaded reels, mounted for rotation within the assemblies. Securing means such as a clasp or ring is mounted on the assembly to facilitate fastening it to a golf bag or the clothing of a person keeping score.

DETAILED DESCRIPTION OF THE DRAWINGS

Figure 1:
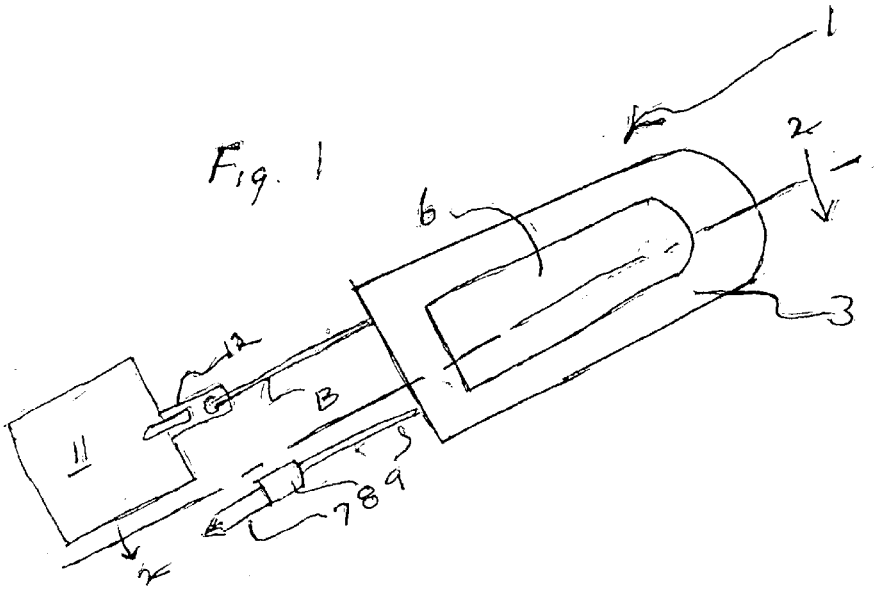
FIG. 1 is a front plan view of the device of the invention.

In the following description of the drawings, the same reference numerals are used to identify similar items as they appear in the several drawings.

In FIG. 1 the overall details of the golf scoring aid 1 of the invention are illustrated. The golf scoring aid has a body portion 3 with a clip 5 (FIG. 2) mounted on one of the elongated side panels of the golf scoring aid 1. A marking device 7, here illustrated as a stub pencil, and a retaining sleeve 8 fixedly attache to the distal end of a cord 9. The cord 9 depends from the bottom of the body portion 3 of the scoring aid 1.

A golf score card 11 is releasably held in a clip 12 which may be of any common design—such as a friction or spring loaded clip. The clip 12, in turn, is attached to the distal end of a cord 13. The clip's 12 supporting cord depends from the body portion 3 of the scoring pad 1.

Figure 2:
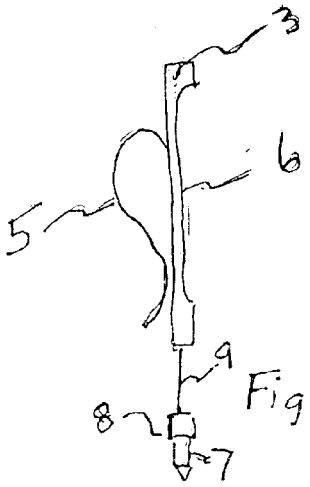
FIG. 2 is a side view of the device of the invention taken along line 2—2 of FIG. 1

When the scoring aid is viewed from its side, as seem in FIG. 2, a fastener 5 is shown attached to the back surface of the scoring pad. The type of fastener used is not important and may assume any configuration such s a friction or spring loaded clip. The fastener 5 may be used to attach the scoring aid 1 to a convenient article of clothing or a golf bag.

The front face of the body portion 3 of the scoring aid 1 may be provided with a recessed area 6. The recess provides no functional purpose other than to serve as an area in which promotional or decorative materials can be positioned. For example, an emblem or logo of a golf course printed on a self adhesive card or decal could be secured in the recess 6.

Figure 3:
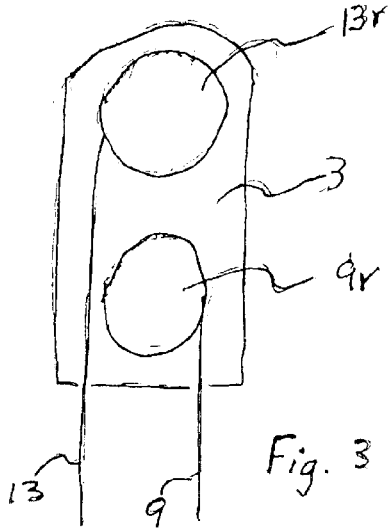
FIG. 3 is an interior view of the device of the invention.

FIG. 3 is a schematic showing or the interior of the body portion 3 of the scoring aid 1. It can be seen that the interior of the body potion 3 supports two reels 9*r* and 13*r* which are mounted for rotation within the body portion 2. The cord 13 that holds the clip 12 and a score card 11 is wound around the upper reel 13*r*. The cord 9 that supports the pencil holder 8 and the pencil 7 is wound around the lower reel 9*r*.

Figure 4:
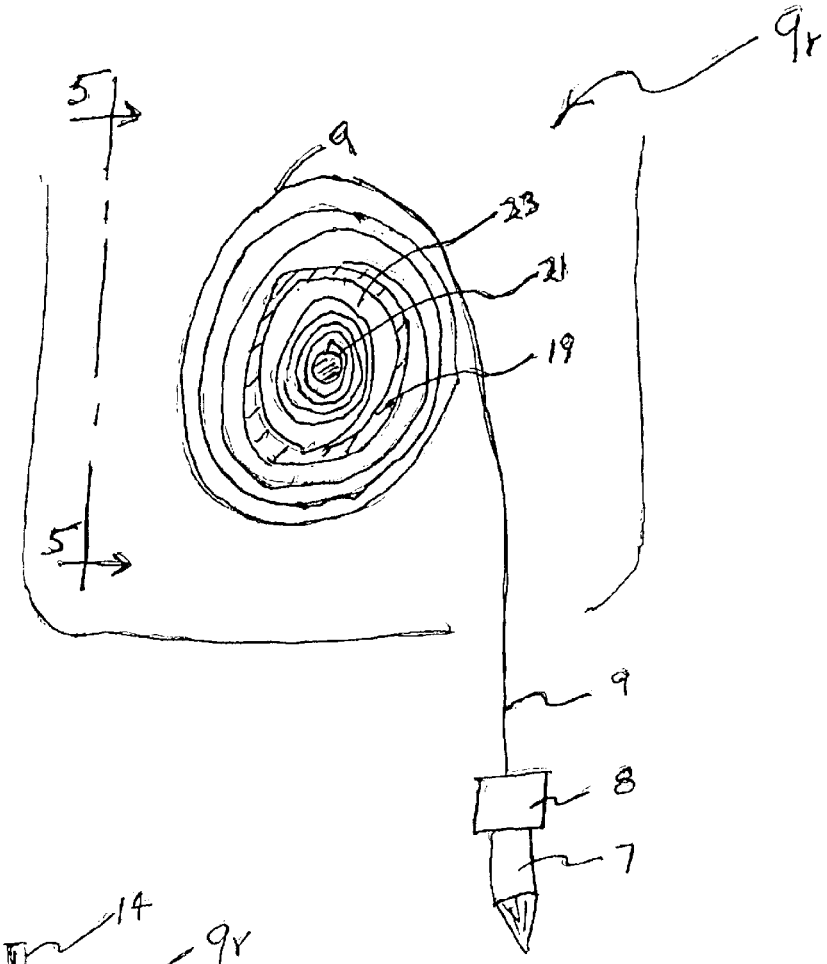
FIG. 4 is a schematic view, partially in section, of a spool mechanism in the interior of the device of the invention.
Figure 5:
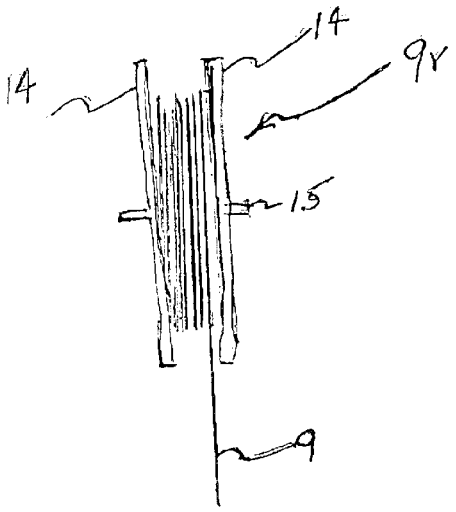
FIG. 5 is a side view of the spool mechanism taken along line 5—5 of FIG. 4.

FIG. 4 and FIG. 5 show the details of the reel structure 9*r* which is similar in design and function as reel 13*r*. The reel 9*r* has spool 14 which is mounted for rotation about axle 15. As can be seen in FIG. 4, the spool 14 has an outer hub 19 and an inner hub 21. The outer hub 19 supports the windings of the cord 9.

The inner hub 21 and the outer hub 19 are mechanically linked by means of spirally wound spring 23. By these means, when the pencil 7 is grasped and pulled away from the scoring aid to enter a score on the score card 11, spiral spring 23 is wound into a tighter configuration. The, when the pencil is released from one's grasp, the spiral spring is biased to unwind and simultaneously wind up cord 9 and return the pencil 7 to a retracted position.

In a similar manner, the score card 11 is held by clip 12 and cord 13 and can be withdrawn against spring bias from its retracted position on its reel 13*r* to any convenient position to facilitate the entry of a score on the score card 11. As with the pencil 7, when the withdrawn score card 11 is released form one's grasp, the score card 11 will be returned to its stored position.

The design of spring loaded reel 9*r* and 13*r* are well known in the art. For example reference is made to U.S. Pat. No. 5,241,593 which discloses a typical construction for a spring loaded reel adapted to allow withdrawal and return of a cord-like structure.

U.S. Pat. No. 4,989,805 discloses another common type of storage reel which has a ratchet mechanism to prevent retraction of a withdrawn cord when it is released. It is necessary to pull the withdrawn cord a slight amount to release the ratchet and allow the spring to unwind and retract the cord. If desired, a ratchet type mechanism can be utilized in the design of the scoring aid of this invention.

What is claimed is:

1. A golf scoring device that holds a golf score card and a marking device in an easily accessible manner comprising:

a housing;

a first and second spring biased reel mounted for rotation within the housing;

a first cord wound around the first reel adapted to be withdrawn from the first reel against spring bias and rewound on the first reel by relaxation of the spring bias;

a second cord wound around the second reel adapted to be withdrawn from the second reel against spring bias an rewound on the second reel by relaxation of the spring bias;

a first gripping device mounted on the free end of the first cord;

a marking device held by the gripping device;

a second gripping device mounted on the free end of the second cord; and a card that may be marked by the marking device held by the second gripping device.

* * * * *